US006886458B1

(12) United States Patent
Iwamoto

(10) Patent No.: US 6,886,458 B1
(45) Date of Patent: May 3, 2005

(54) APPARATUS FOR ADJUSTING PRINTING PRESSURE OF SATELLITE-TYPE PRINTING PRESS

(75) Inventor: Masayuki Iwamoto, Shizuoka (JP)

(73) Assignee: Shinohara Machinery Co., Ltd., Shizuoka-ken (JP)

( * ) Notice: Subject to any disclaimer, the term of this patent is extended or adjusted under 35 U.S.C. 154(b) by 20 days.

(21) Appl. No.: 10/739,996

(22) Filed: Dec. 18, 2003

(51) Int. Cl.[7] ..... B41F 7/10; B41F 13/34

(52) U.S. Cl. ..... 101/177; 101/218; 101/182; 101/247

(58) Field of Search ..... 101/181, 182, 101/183, 184, 185, 174, 177, 216, 217, 218, 101/219, 247, 139, 140, 142, 143, 144, 145

(56) References Cited

U.S. PATENT DOCUMENTS

| | | | | |
|---|---|---|---|---|
| 5,311,817 A * | 5/1994 | Funada | ..... | 101/177 |
| 5,363,762 A * | 11/1994 | Belanger | ..... | 101/177 |
| 6,601,504 B2 * | 8/2003 | Kanayama | ..... | 101/218 |

FOREIGN PATENT DOCUMENTS

| | | |
|---|---|---|
| JP | 3-1947 | 1/1991 |
| JP | 8-29586 | 3/1996 |
| JP | 8-244195 | 9/1996 |

* cited by examiner

*Primary Examiner*—Leslie J. Evanisko
(74) *Attorney, Agent, or Firm*—Ladas & Parry LLP

(57) ABSTRACT

An apparatus for integrally and conveniently adjusting printing pressures of blanket cylinders in a satellite-type printing press is provided. Printing pressure is adjusted all together by rotating eccentric bearing means (26) of a plurality of blanket cylinders (18) by wheel (34) which is fixed to primary axis (28), penetrating through the center of common pressure cylinder (10).

2 Claims, 3 Drawing Sheets

APPARATUS FOR ADJUSTING PRINTING PRESSURE OF SATELLITE-TYPE PRINTING PRESS

BACKGROUND OF THE INVENTION

1. Field of the Invention

The present invention relates generally to sheet-fed satellite-type printing press, or more precisely, to apparatus for adjusting printing pressure for such press.

2. Description of the Prior Art

Satellite-type printing press is already known by, for example, Japanese published unexamined patent application No. 244195/1996 where many printing units (for example, four color units) are provided in satellite-like manner around common pressure cylinder of relatively large diameter. As the thickness of sheet to be printed is diversified, contact pressure between common pressure cylinder and blanket cylinder of each printing units must be adjusted in correspondingly.

In Japanese published unexamined patent application No. 1947/1991, blanket cylinders which are supported by double eccentric bearings are, in sheet-fed serial printing press, simultaneously adjusted in relation to each pressure cylinders.

Also in Japanese published examined patent No. 29586/1996, a plurality of gripper bases which are equally provided around sheet transfer cylinder are integrally adjusted from the center of cylinder, so as to adjust grippers in compliance with different sheet thickness.

SUMMARY OF THE INVENTION

The present invention provides new and improved apparatus for adjusting printing pressure of satellite-type press and aims at adjusting the pressure of many blanket cylinders integrally and conveniently. Other object is to allow, in addition to such integral adjustment, individual fine adjustment in compliance with the circumstances of each printing units.

To achieve these objects, apparatus for adjusting printing pressure according to the present invention comprises a primary axis (28) which penetrates through the center of common pressure cylinder (10) and is supported independently from the cylinder (10), a wheel (34) which is fixed to the end of the primary axis (28), linking means (36) one end of which is connected to the wheel (34) and the other end to eccentric bearing means (26) for blanket cylinders (18), and drive means (40) for rotating the wheel (34).

In addition, fine adjusting means (38) is provided on the way of each linking means (36).

In case pressure adjustment is required due to the diversity of sheet thickness to be printed by satellite-type press, drive means (40) is activated to rotate the wheel (34) with primary axis (28) to some extent. The torque causes rotation of the eccentric bearing means (26) by way of linking means (36) and finally printing pressure is adjusted.

These and other objects of the invention will become apparent from the following description with reference to the drawings. But these show merely an embodiment of the present invention.

DESCRIPTION OF PREFERRED EMBODIMENT

Figure 1:
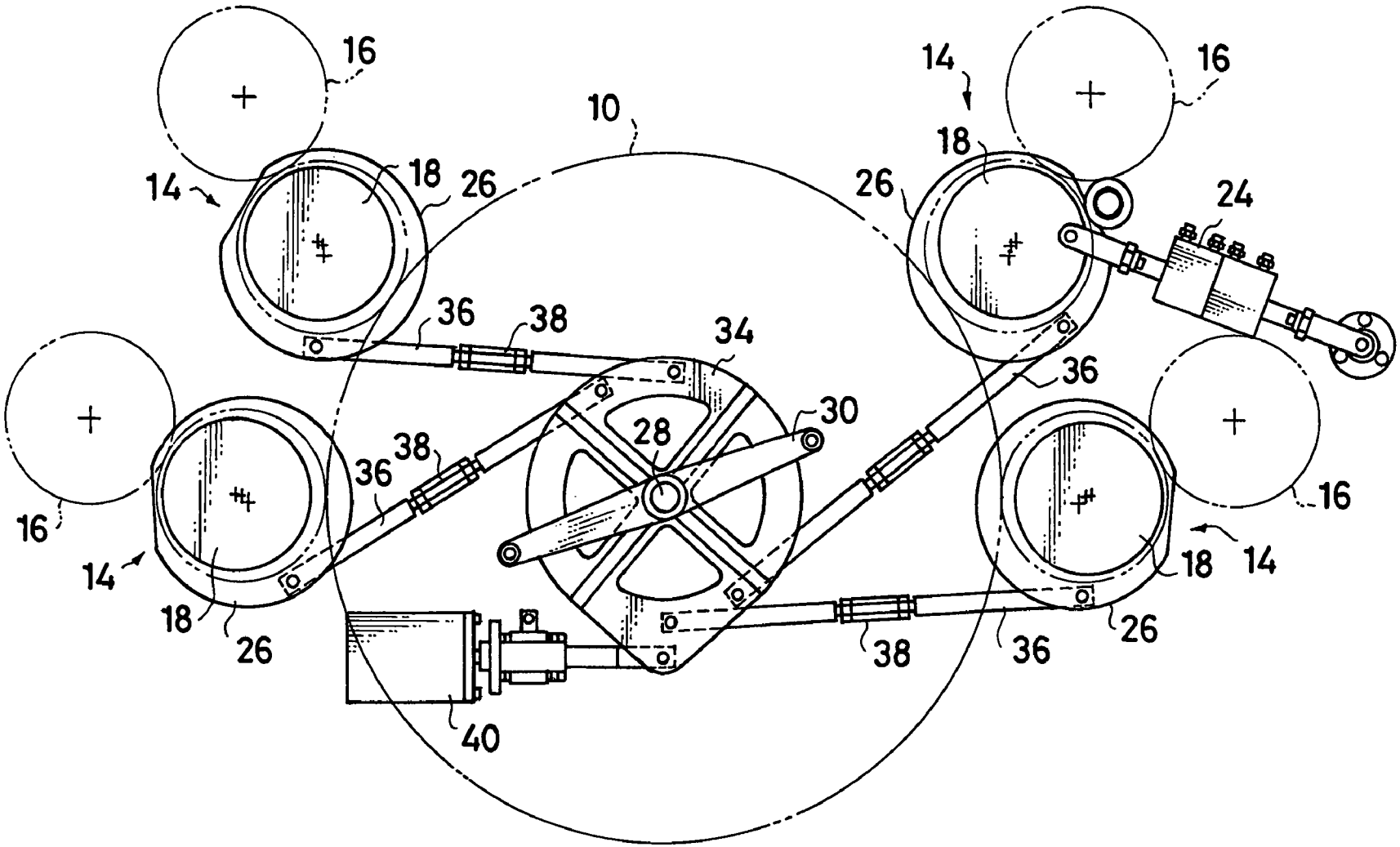
FIG. 1 is a schematic side view showing an embodiment of apparatus for adjusting printing pressure according to the present invention.

In the center of FIG. 1, common pressure cylinder (10) of relatively large diameter is shown and, already well known from Japanese published unexamined patent application No. 244195/1996, is rotary supported between a pair of frames (12) of printing press and is driven by motor (not shown).

Although not shown, several numbers of grippers which grip the end of sheet are equipped on the periphery of common pressure cylinder (10). The common pressure cylinder (10) is a base for accepting sheet from feeding cylinder in the upper stream (right side of FIG. 1) and, after printing, for delivering the printed sheet to delivery device in the lower stream (left side of FIG. 1).

Four sets of printing units (14) are provided around the common pressure cylinder (10). In order to perform color offset printing, these printing units (14) have plate cylinders (16) equipped with printing plates and blanket cylinders (18) to transfer images. Additionally, inking as well as dampening devices are attached to plate cylinders (16). The diameter of the common pressure cylinder (10) is integer times (for example, four times) as large as that of plate cylinder (16) of printing units (14) in order to perform multi-color printing by these printing units (14) in compliance with the rotation of common pressure cylinder (10) which is driven by motor (not shown).

Figure 3:
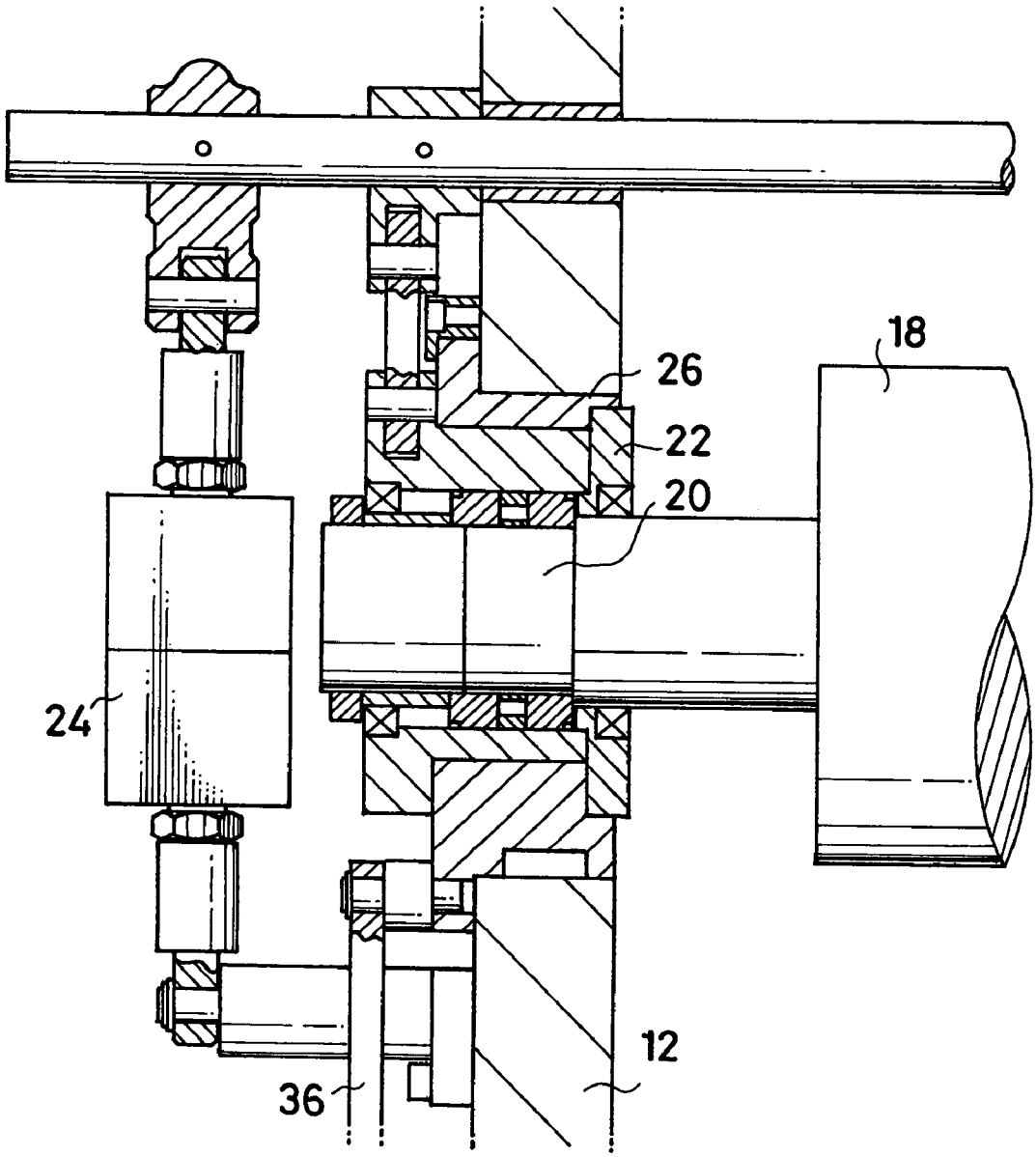
FIG. 3 is a sectional view showing bearing means of blanket cylinder to be adjusted.

Both ends of cylinder axis (20) of blanket cylinders (18) to be adjusted are, as well known from before-mentioned Japanese published unexamined patent application No. 1947/1991, supported between side frames (12) by double eccentric bearings. An example of such double eccentric bearing means is shown in FIG. 3 for reference. Inner eccentric bearing (22) is for throw-in and pull-out of blanket cylinders (18). It is well known in the art that blanket cylinders (18) are thrown in and pulled out in relation to the fixed common pressure cylinder (10) and plate cylinder (16) by rapidly rotating the inner eccentric bearing (22) with the aid of air cylinder (24).

On the premise of such throw-in and pull-out of blanket cylinders (18), printing pressure adjustment is carried out by changing the distance between the centers of common pressure cylinder (10) and blanket cylinders (18) so as to adjust the contact pressure between them. To achieve such adjustment, outer eccentric bearing (hereafter called eccentric bearing means (26)) of double eccentric bearing must be rotated to some extent.

Figure 2:
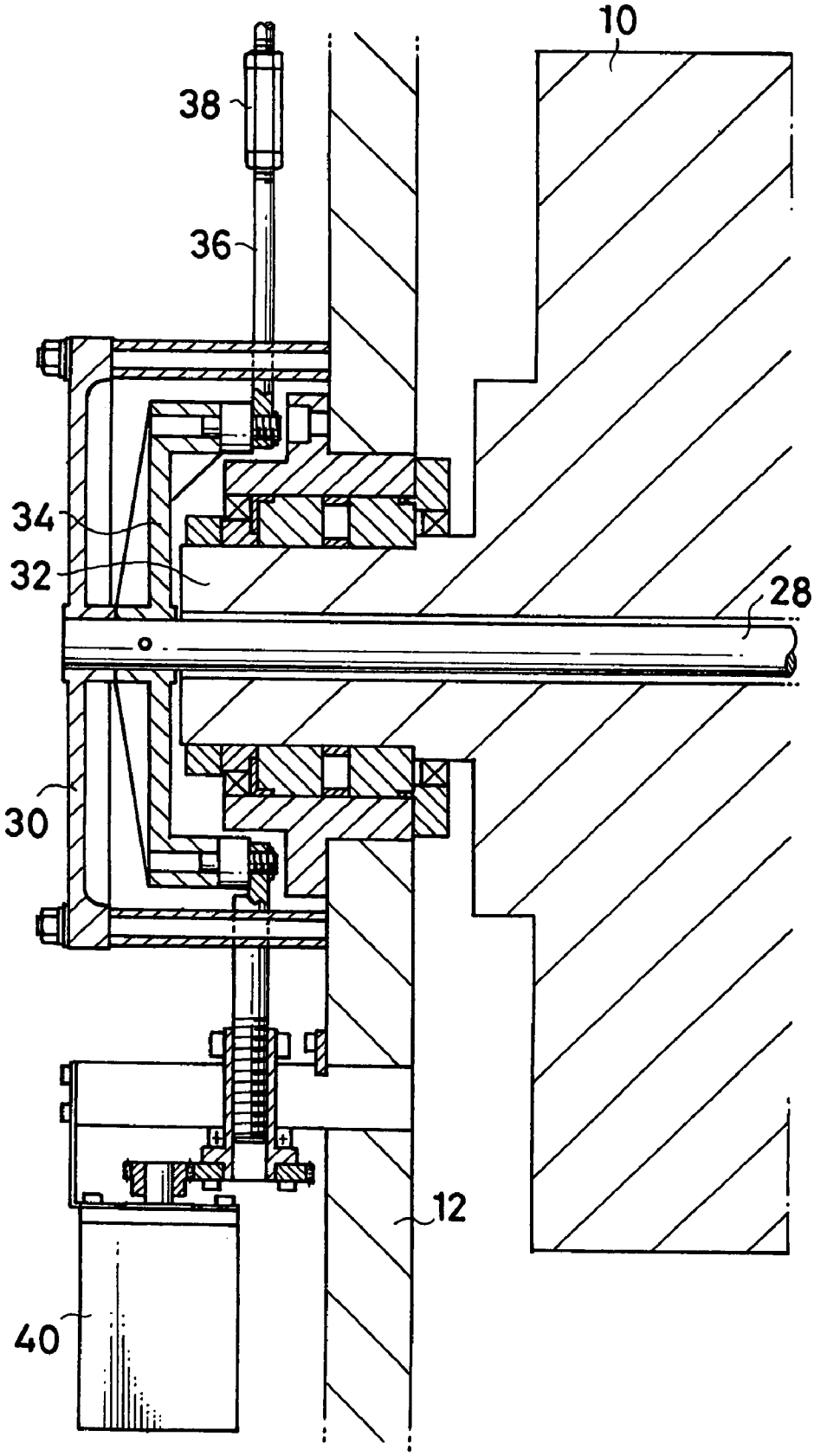
FIG. 2 is a partial section showing above embodiment.

As shown in FIG. 2, primary axis (28) penetrates through the center of common pressure cylinder (10) and both ends of it are rotary supported by bracket (30) which is fixed to side frames (12). There is, as shown, some clearance between the primary axis (28) and cylinder axis (32) of common pressure cylinder (10), therefore, the primary axis (28) is freely and independently supported.

Wheel (34) is fixed to the end of primary axis (28). To transmit torque from the center of common pressure cylinder (10) to the eccentric bearing means (26) of blanket cylinders (18) which are disposed in satellite-like manner, linking means (36) is provided. One end of the linking means (36) is connected to the wheel (34) and the other end to each eccentric bearing means (26).

In order to comply with the request for fine adjustment due to particular circumstances (production error, time declination and so forth), fine adjusting means (38) such as turn-buckle is provided on the way of each linking means (36).

Drive means (40) such as by an air cylinder is connected to the wheel (34) in order to rotate a plurality eccentric bearing means (26) all together from the center of common pressure cylinder (10).

Next, operation of above construction is described. In case pressure adjustment is requested due to the shift of sheet thickness to be printed by satellite-type press, drive means (40) is activated by order signal (including sheet thickness information) from control console. By the force from drive means (40), the wheel (34) is rotated which is fixed to the primary axis (28), penetrating through the center of common pressure cylinder (10) and utterly independent from it.

The rotation of wheel (34) causes the movement of eccentric bearing means (26) of the plurality of blanket cylinders (18) by way of linking means (36), thereby, the distance between the center of common pressure cylinder (10) and that of each blanket cylinders (18) is adjusted all together for printing pressure adjustment.

By the apparatus for adjusting printing pressure according to the present invention, printing pressure of a plurality of blanket cylinders can be adjusted all together from the center of common pressure cylinder, therefore, working burden for pressure adjustment can be enormously be reduced.

The present invention is not limited to the embodiment described hitherto. Various changes and modifications can, of course, be made without departing from the spirit of the invention.

What is claimed is:

1. In a satellite-type printing press where blanket cylinders (18) of a plurality of printing units (14) are provided in satellite-like manner around common pressure cylinder (10) of relatively large diameter and cylinder axes (20) of said blanket cylinders (18) are supported by eccentric bearing means (26) in order to adjust the distance from the center of said common pressure cylinder (10) to that of said blanket cylinders (18);

apparatus for adjusting printing pressure comprising;

primary axis (28) which penetrates through the center of said common pressure cylinder (10) and is supported independently from said cylinder (10), wheel (34) which is fixed to the end of said primary axis (28), linking means (36) one end of which is connected to said wheel (34) and the other end to said eccentric bearing means (26), and drive means (40) for rotating said wheel (34).

2. Apparatus for adjusting printing pressure according to claim 1, wherein fine adjusting means (38) is provided on the way of each linking means (36).

* * * * *